United States Patent [19]

Thompson

[11] Patent Number: 4,576,556

[45] Date of Patent: Mar. 18, 1986

[54] ROLLER PUMP

[75] Inventor: Howard J. Thompson, New Richmond, Wis.

[73] Assignee: Medtronic, Inc., Minneapolis, Minn.

[21] Appl. No.: 136,812

[22] Filed: Apr. 2, 1980

[51] Int. Cl.[4] ..... F04B 43/12

[52] U.S. Cl. ..... 417/477

[58] Field of Search ..... 417/477

[56] References Cited

U.S. PATENT DOCUMENTS

| | | | |
|---|---|---|---|
| 2,899,906 | 8/1959 | Becher et al. | 417/477 |
| 3,249,059 | 5/1966 | Renn | 417/477 |
| 3,591,319 | 7/1971 | Shlisky | 417/477 |
| 3,723,030 | 3/1973 | Delfand | 417/477 X |
| 4,231,668 | 11/1980 | Groth et al. | 417/477 X |

FOREIGN PATENT DOCUMENTS

| | | | |
|---|---|---|---|
| 2535650 | 2/1977 | Fed. Rep. of Germany | 417/477 |

OTHER PUBLICATIONS

Carlson et al., New Low Power High-Reliability Infusion Pump, New England (Northeast), Bioengineering Conf., Troy, N.Y., 1979, Pergamon Press, pp. 193-196.

*Primary Examiner*—Richard E. Gluck
*Attorney, Agent, or Firm*—Vidas & Arrett

[57] ABSTRACT

A roller pump in which one or more hoses is compressed against an arcuate stator bearing surface by a plurality of rollers carried by a rotating rotor. A shim is provided in generally opposing relation to the stator bearing surface to impart a hose compression offset force to the rotor. In this manner, the forces imparted to the rotor remain substantially constant throughout its rotation. In a preferred embodiment, a liner, which may be unitary with the shim, overlies the hoses to be compressed by the rotor to compensate for dimensional variations between the rotor rollers and for variations in the bearing surface and the hoses themselves. The thickness of the shim, at its region of greatest thickness, approximates the combined thickness of the hose, when fully compressed, and the compensating liner. Tabs are provided to extend from the shim to assist in maintaining the shim and liner in proper orientation relative to the hoses to be compressed.

2 Claims, 5 Drawing Figures

ROLLER PUMP

BACKGROUND OF PRIOR ART

Roller pumps are known to the prior art and have wide application in the medical field. A typical application for such a pump is as a blood pump during hemodialysis, for example. Other applications are well known. The simplicity and reliability of roller pumps has resulted in their wide acceptance within the medical community.

Typically, medical roller pumps employ a stator having a bearing surface against which one or more hoses is compressed by a rotating rotor, the rotor engaging the hoses with two or more rollers. On rotation of the rotor, the fluid medium in the hose or hoses is transported in the direction of the rotor rotation. Alternatively, the fluid may be presented to the pump under pressure such that rotation of the rotor causes the pump to serve as a measuring valve. In either instance, knowledge of the inner diameter of the hose or hoses and the rotational speed of the rotor provides a knowledge of the amount of fluid passed through the hose or hoses, which amount can be regulated by regulating the speed of the rotor.

Among the problems encountered in prior art roller pumps are dimensional variations in the rotor rollers as well as variations in the stator bearing surface and the hoses themselves. In addition, the rotor rollers have not always rolled over the hoses but, instead, have a tendency to "scuff" the hoses. Hose flutter is also known. Each of these phenomena, if prolonged, may result in mechanical failure of the hoses. Also, because the hose is not compressed against the stator bearing surface throughout the full 360° rotation of the rotor, the forces imparted to the rotor are not uniform throughout its rotation. In larger pumps, this can be countered by increases in the size of the driving shaft. However, in smaller units, this solution may not be practical. In all cases, this results in significant variations in the torque required to rotate the rotor through 360°.

BRIEF SUMMARY OF THE INVENTION

The present invention provides an improved roller pump by employing a shim in opposing relation to the stator bearing surface. The shim imparts a hose compression counterbalancing or offset force to the rotor thereby equalizing the forces imparted to the rotor throughout its 360° rotation. Additionally, a liner may extend from the shim to overlie each hose in the stator bearing surface region to compensate for dimensional variations between the rotor rollers as well as variations in the bearing surface and the hoses themselves. In a preferred embodiment, the thickness of the shim, in its region of greatest thickness, approximates the combined thickness of the hose, when fully compressed, and the compensating liner. Tabs may be provided to cooperate with the stator structure to assist in maintaining the shim/liner structure in the desired position.

DETAILED DESCRIPTION OF THE INVENTION

Figure 1:
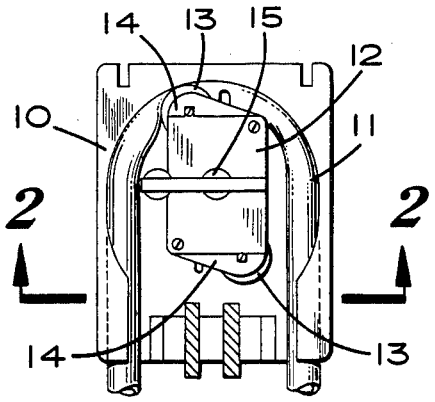
PRIOR ART Fig 1
FIG. 1 illustrates a prior art roller pump.
Figure 2:
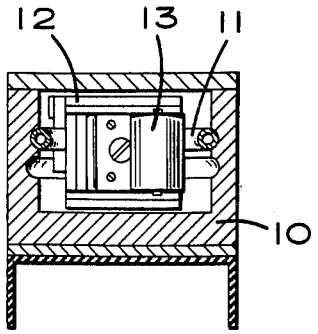
PRIOR ART Fig 2
FIG. 2 illustrates a cross-section of the prior art roller pump of FIG. 1 taken along the line 2—2 in FIG. 1.

FIGS. 1 and 2 illustrate a typical prior art roller pump having a stator 10 which provides a bearing surface for one or more hoses 11. A rotor 12 is rotatable through 360° and carries a plurality of rollers 13 which engage the hose or hoses 11 and compress them against the stator 10 bearing surface to regulate the flow of fluid through the hoses 11. Typically, the rollers 13 are carried on biased levers 14 which maintain uniform compressing pressure on the hoses 11. The roller pump of FIGS. 1 and 2 is that disclosed in U.S. Pat. No. 4,108,575 issued Aug. 22, 1978, to Schal for OBTAINING DESIRED FLOW RATE FROM THE ROLLER PUMP DESPITE VARYING THE HOSE MEANS, which patent is hereby incorporated by reference.

The rotor 12 of the roller pump of FIGS. 1 and 2 is driven by a rotor shaft 15 which, itself, is driven by a suitable motor. When in the position illustrated in FIG. 1, the compression of the hose 11 by the uppermost roller 13 imparts a force to rotor 12 which is not counterbalanced or offset by a corresponding force applied to the lowermost roller 13 inasmuch as the lowermost roller 13 is not in engagement with the hose 11. In smaller units, requiring a relatively small rotor shaft 15, this could have a tendency to deflect the rotor shaft 15 to result in a less than complete compression of the hose 11 against the bearing surface of the stator 10. This could result in a leakage past the uppermost rotor 13 and an inaccuracy in the assumed amount of fluid flow through the hose 11. This is especially true when the fluid is supplied to the hose under pressure and may be critical when that fluid is a medication to be dispensed with the roller pump serving to regulate the amount of medication dispensed.

Figure 3:
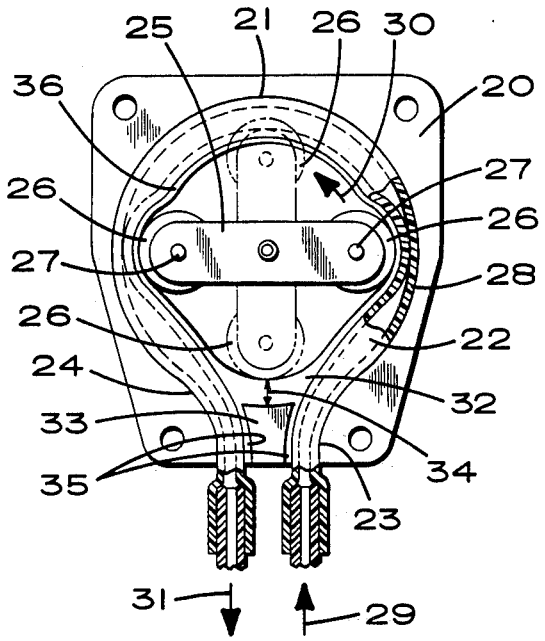
FIG. 3 illustrates diagrammatically the roller pump improvement of the present invention.

The present invention provides means for imparting a compensating or offsetting force to the rotor when one of the rotor rollers is not in compressing relation to the roller pump hose or hoses. This is illustrated diagramatically in FIG. 3 which illustrates a stator 20 having a generally cylindrical bearing surface 21 with a hose 22 extending from a stator hose inlet 23 to a stator hose outlet 24 and overlying the arcuate stator bearing surfce 21. A rotor 25 carries a plurality of rolles 26 (two shown) which rotate about a central axis 27, in known manner, to compress the hose 22 against the stator bearing surface 21. Preferably the compression is complete, as illustrated in cutaway at 28 to eliminate leakage. Of course, the rollers 26 can be carried by levers or be otherwise spring biased to regulate the amount of compressing force applied to the hose 22, the particular design of the rotor 25 and rollers 26 forming no part of the present invention.

With a fluid supply entering the hose 22 as indicated by the arrow 29, and with the rotor 25 rotating in the direction indicated by the arrow 30, the fluid will be moved through the tube 22 to exit from the tube 22 as indicated by the arrow 31. However, and as indicated with reference to the discussion of FIGS. 1 and 2, as the rotor approaches the position illustrated in phantom in FIG. 3, the disengagement of the lowermost roller from the hose 22 will result in a force being imparted to the uppermost roller by the compressed hose without a counterbalancing or offsetting force on the lowermost roller. This force has a tendency to cause a deflection of the rotor assembly to result in less than a complete compression of the hose 22 and, accordingly, a leakage past the uppermost roller 26. In the present invention, this force is countered or offset by a shim member 32 which engages the lowermost phantom roller 26 to impart a force thereto which compensates or offsets for the force imparted by the compressed hose 22 to the uppermost phantom roller 26. The shim 32 is supported by a backing member 33 and tapers from its region of greatest thickness (overlying the backing member 33) in accordance with the configuration of the bearing surface 21 and the amount of compressing of the hose 22 that it overlies, in a manner which is easily determinable by one of ordinary skill in the art. In addition to minimizing leakage, the shim of the present invention also provides a more uniform torque requirement for the motor driving the rotor 25.

Tabs 35 extend from the shim 32 and into the hose inlet and outlet ports 23 and 24 to help maintain the shim 32 in position against rotation of the rotor 25, and the rollers 26 which contact it, as well as helping to properly position the hose 22 within the inlet and outlet ports 23 and 24. Also extending from the shim 32 is a liner 36 which is preferably unitary with the shim 32 to overlie the hose 22 intermediate the hose 22 and the rollers 26. The linear 36 compensates for dimensional variations between the rotor rollers 26 as well as dimensional variations in the bearing surface 21 and the hose 22, itself. Alternatively, the linear 36 may be formed separately of the shim 32 to overlie both the shim 32 and hose 22 to provide the stated functions. In addition to compensating for dimensional variations, the linear 36 also prevents a scuffing of the hose 32 by the rollers 26 while the entire structure formed of shim 32, tabs 35 and liner 36 reduce hose flutter which, like a scuffing of the hose 22 by rollers 26, could result in premature hose failure. In the preferred embodiment illustrated in FIG. 3, including the liner 36, the thickness of the shim in its region of greatest thickness (the thickness at arrow 34, for example) approximates the combined thickness of the hose, when fully compressed, and the liner 36, the backing member providing an arcuate surface that constitutes an extension of the generally cylindrical bearing surfce 21. The shim 32 and liner 36 may be made of any suitable material, silicone, for example.

Figure 4:
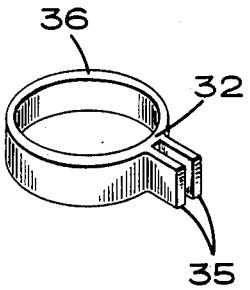
FIG. 4 is a perspective view of a preferred embodiment of the roller pump improvement illustrated in FIG. 3.
Figure 5:
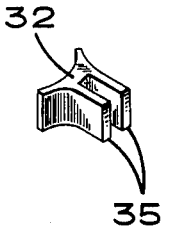
FIG. 5 illustrates an alternative embodiment to the embodiment of FIG. 4.

Obviously, many modifications and variations of the present invention are possible in light of the above teachings. One such modification is illustrated in FIGS. 4 and 5, FIG. 4 illustrating a unitary structure formed of shim 32, tabs 35 and liner 36 while FIG. 5 illustrates a unitary structure formed of shim 32 and tabs 35. The structure of FIG. 5 may be employed with or without a separate liner structure, dependent on the desired application and the problems encountered, without departing from the scope of the present invention. Also, while disclosed in terms of a roller "pump," it is contemplated that the improvement disclosed herein may be employed with a roller pump structure in which the fluid entering the hose 22, as indicated at arrow 29, is under pressure with the rotation of the rotor 25 serving to regulate the amount of fluid allowed to pass through the hose 22 within the stator 20. Indeed, it is contemplated that preferred embodiments of the present invention will be employed within a drug dispensing mechanism with the drug to be dispensed being maintained in a reservoir under pressure and supplied to the hose 22 as at the arrow 29. The roller pump may thus serve a medical purpose in dispensing the drug in an amount established by the inner diameter of the hose 22 and the speed of the rotor 25. It is therefore to be understood that, within the scope of the appended claims, the invention may be practiced otherwise than as specifically described.

I claim:

1. In a medical roller pump of the type having a stator, including hose inlet and outlet means and a generally arcuate bearing surface, having hose means extending from said hose inlet means to said hose outlet means along said bearing surface, and having rotor means rotatable through 360°, said rotor means carrying a plurality of roller means for compressing said hose means against said bearing surface, the improvement which comprises shim means including backing support means in generally opposing relation to said bearing surface for imparting a hose compression counterbalancing force to said rotor means thereby equalizing the forces imparted to said rotor means throughout its 360° rotation.

2. The medical roller pump of claim 1 wherein the thickness of said shim means, at its region of greatest thickness, approximates the distance between a rotor roller means and said bearing surface while said rotor roller means is fully compressing said hose means.

* * * * *

UNITED STATES PATENT AND TRADEMARK OFFICE

CERTIFICATE OF CORRECTION

PATENT NO. : 4,576,556

DATED : March 18, 1986

INVENTOR(S) : Howard J. Thompson

It is certified that error appears in the above-identified patent and that said Letters Patent are hereby corrected as shown below:

Col. 3, line 48, Delete "surfce" & Insert - surface -

Signed and Sealed this

First Day of July 1986

[SEAL]

Attest:

DONALD J. QUIGG

Attesting Officer

Commissioner of Patents and Trademarks

UNITED STATES PATENT AND TRADEMARK OFFICE

CERTIFICATE OF CORRECTION

PATENT NO. : 4,576,556

DATED : March 18, 1986

INVENTOR(S) : Howard J. Thompson

It is certified that error appears in the above-identified patent and that said Letters Patent are hereby corrected as shown below:

Column 2, line 51, the word appearing as "rolles" should read --rollers--.

Column 3, line 48, the word appearing as "surfce" should read --surface--.

This certificate supersedes certificate of correction issued July 1, 1986.

Signed and Sealed this

*Nineteenth* Day of *August 1986*

[SEAL]

*Attest:*

DONALD J. QUIGG

*Attesting Officer*

*Commissioner of Patents and Trademarks*